United States Patent [19]

Ignasiak

[11] Patent Number: 5,033,977

[45] Date of Patent: Jul. 23, 1991

[54] ELECTRICAL CONNECTOR AND FIXTURE FOR FOUR-SIDED INTEGRATED CIRCUIT DEVICE

[75] Inventor: Martin C. Ignasiak, Mentor, Ohio

[73] Assignee: Minnesota Mining & Manufacturing Co., St. Paul, Minn.

[21] Appl. No.: 404,318

[22] Filed: Sep. 7, 1989

Related U.S. Application Data

[63] Continuation-in-part of Ser. No. 107,958, Oct. 13, 1987, abandoned.

[51] Int. Cl.[5] ..... H01R 9/09

[52] U.S. Cl. ..... 439/482; 324/158 P; 439/352; 439/526; 439/912

[58] Field of Search ..... 439/68–73, 439/263, 264, 266, 330, 912, 525, 526, 482, 352; 324/158 F, 158 P, 72.5; 361/403

[56] References Cited

U.S. PATENT DOCUMENTS

| | | | |
|---|---|---|---|
| Re. 28,064 | 12/1967 | Venaleck et al. | 439/269 |
| 3,297,974 | 1/1967 | Pittman | 439/353 |
| 3,345,541 | 10/1967 | Cobaugh et al. | 206/328 |
| 3,380,016 | 4/1968 | Samson et al. | 361/403 |
| 3,899,239 | 8/1975 | Allard | 439/711 |
| 3,914,007 | 10/1975 | Seidler | 439/912 |
| 3,968,433 | 7/1976 | Dobarganes | 324/158 F |
| 4,012,097 | 3/1977 | Long et al. | 324/158 F |
| 4,027,935 | 6/1977 | Byrnes et al. | 439/862 |
| 4,451,676 | 9/1985 | Hansen et al. | 439/912 |
| 4,491,377 | 1/1985 | Pfaff | 439/267 |
| 4,518,910 | 5/1985 | Hottenrott et al. | 324/158 F |
| 4,554,506 | 11/1985 | Faure et al. | 324/158 P |
| 4,556,269 | 12/1985 | Andersson et al. | 439/912 |
| 4,638,406 | 1/1987 | Samson | 174/52 FF |
| 4,671,590 | 6/1987 | Ignasiak | 439/266 |
| 4,671,592 | 6/1987 | Ignasiak et al. | 439/70 |
| 4,735,580 | 4/1988 | Hansen et al. | 439/264 |
| 4,747,017 | 5/1988 | Koors | 361/395 |
| 4,810,211 | 5/1989 | Hutnak et al. | 361/403 |
| 4,846,702 | 7/1989 | Ignasiak et al. | 439/71 |

FOREIGN PATENT DOCUMENTS

| | | | |
|---|---|---|---|
| 514457 | 5/1976 | U.S.S.R. | 324/158 P |

OTHER PUBLICATIONS

Faure, "Test Probe", IBM Technical Disclosure Bulletin, vol. 18, No. 8 (1976).

Lipschutz et al., "Buckling Wire Probe Assembly", IBM Technical Disclosure Bulletin, vol. 15, No. 15 (1973).

*Primary Examiner*—Neil Abrams

*Attorney, Agent, or Firm*—Renner, Otto, Boisselle & Sklar

[57] ABSTRACT

A novel electrical connector and fixture for surface mounted leaded chip carriers, particularly for quad pack integrated circuit packages. The fixture includes a rectangular frame that supports the leads extending from the four sides of the integrated circuit package. The connector includes a plurality of contact members securely mounted in an outer housing member. The contact members have flexible contacting portions arranged for registration with the leads. Each contacting portion projects slightly from and is surrounded by an insulating wall that protects the contacting portions from touching each other when they are subjected to an axial buckling stress. The ends of the contact members opposite the contacting portions project from the outer housing member sufficiently separated for connection with other apparatus such as a test probe, electrical connector, etc. The outer housing member slides on an inner support member along an axis generally perpendicular to the IC package with which the connector is used. The inner support member includes registration pins that engage a registration index on the fixture. The outer housing member is urged towards the IC package to establish electrical contact between the leads and contact members. The connector applies force to the leads substantially perpendicular to the leads where they are supported by the fixture. A latch mechanism is provided to hold the connector engaged with the IC package.

22 Claims, 6 Drawing Sheets

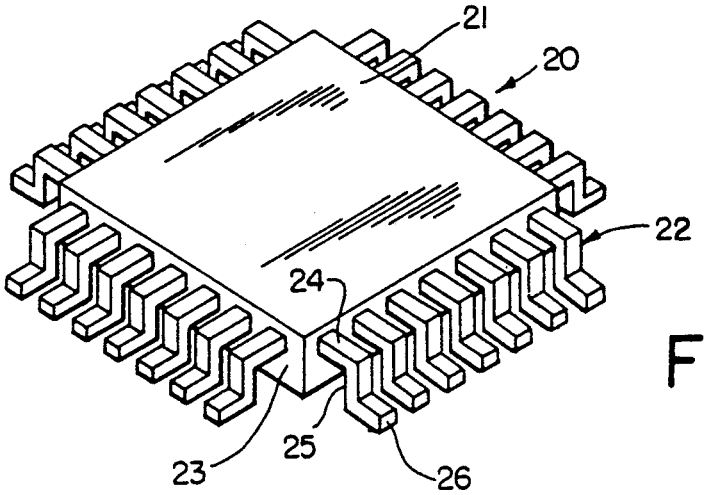
FIG. 1
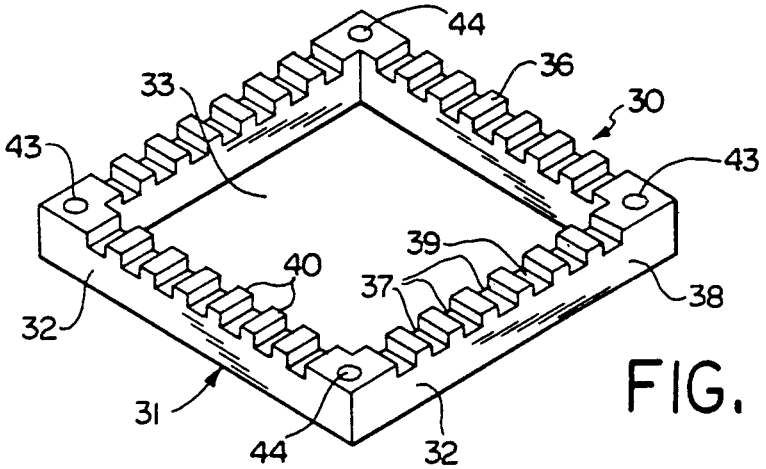
FIG. 2
FIG. 4
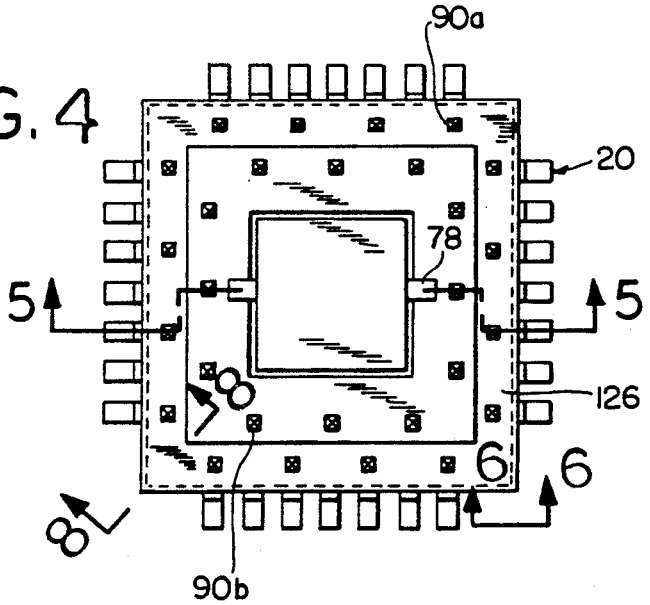

ELECTRICAL CONNECTOR AND FIXTURE FOR FOUR-SIDED INTEGRATED CIRCUIT DEVICE

RELATED APPLICATION DATA

This application is a continuation-in-part of application Ser. No. 107,958, filed Oct. 13, 1987, now abandoned and entitled "Electrical Connector For Surface Mounted Chip Carrier", which application is hereby incorporated herein by reference.

BACKGROUND OF THE INVENTION

The invention herein described relates generally to an electrical connector and fixture for a four-sided integrated circuit device.

For many years integrated circuits have been housed in dual-in-line packages (DIPs). A DIP has parallel rows of leads which extend from opposite sides of a body that houses an integrated circuit chip. The body of the DIP usually is rectangular and typically from 14 to 64 leads are spaced along the longer sides of the body on 0.100 inch (2.54 mm) centers. The DIP ordinarily is installed on a printed circuit board by soldering the leads to the circuit board or by inserting the leads into a DIP socket which has been soldered to the circuit board.

A number of test devices have been designed for testing DIPs. Examples of these devices are disclosed in the following U.S. patents:

| No. | Patentee |
|---|---|
| RE. 28,064 | Venaleck et al |
| 3,914,007 | Seidler |
| 4,012,097 | Long et al |

A number of fixtures or mounts also have been provided for DIPs and other electrical components, examples of which are shown in the following U.S. patents:

| No. | Patentee |
|---|---|
| 3,345,541 | Cobaugh et al |
| 3,968,433 | Dobarganes |
| 4,638,406 | Samson |

More recently, integrated circuit packages have been developed wherein leads are provided along four sides of a body that houses an integrated circuit chip or chips. Typically, the body or housing containing the integrated circuit is square and an equal number of leads are arranged along each side of the body. These integrated circuit devices are referred to as LCCs for leaded chip carriers. The leads usually are more closely spaced than the leads in a DIP device, and this coupled with the leads being located along all four sides of the LCC in part enables more denser packing of integrated circuits on printed circuit boards. Like a DIP, an LCC may be installed on a printed circuit board by soldering the leads thereof to the circuit board. However, the LCC ordinarily is surface mounted on the printed circuit board.

State-of-the-art LCCs, such as those known as quad flat pack carriers, or more simply quad packs, may have a large number such as 132 leads with 33 leads per side of the carrier body. The leads of these quad packs typically are quite delicate and are easily damaged and more easily displaced.

As with DIPs, it is desirable to have an electrical connector such as a test probe for making temporary electrical connections with each of the leads of an LCC for testing while the LCC is in place on a printed circuit board. Since the LCC has leads located along each of the four sides of the LCC body, test probes for DIPs cannot be used since they connect with leads on only two opposed sides of an integrated circuit package. Likewise, various fixtures or mounts provided for DIPs cannot be used with LCCs. In an effort to satisfy the need for a test probe for an LCC, a few electrical connector devices have been developed. Examples of these electrical connector devices are shown in the following U.S. patents:

| No. | Patentee |
|---|---|
| 4,541,676 | Hansen et al |
| 4,556,269 | Anderson et al |
| 4,671,590 | Ignaziak |
| 4,671,592 | Ignaziak |

These devices, in general, apply pressure to surface mounted leads of an LCC in a direction parallel to the printed circuit board. This does not present a problem with LCCs including J-shape, surface mount leads. However, a problem may arise if used with a quad pack surface mounted to a printed circuit board because the thin and fragile leads of the quad pack may not be able to withstand the pressure applied by the four-sided devices disclosed in these patents.

Accordingly, it would be desirable to provide an electrical connector for electrically connecting with an LCC or similar device wherein leads are arranged along four sides of the device. More particularly, it would be desirable to provide an electrical connector and related structure for enabling electrical connection to a surface mounted quad pack having a relatively large number of fragile leads.

SUMMARY OF THE INVENTION

In accordance with the invention, a connector is provided for establishing electrical communication between an external device and the outwardly extending leads of an integrated circuit device, such as an LCC that is surface mounted to a printed circuit board, which, for example, contains a high density of LCC's. In a preferred embodiment, the connector includes a plurality of unitary, electrically conducting contact members, each having a contacting portion at one end. The contacting portions are arranged to register with the leads of an LCC so that electrical contact between each of the LCC leads and one of the contacting portions may be made. A central mounting portion of each contact member is held in an electrically non-conducting body of the connector. Coupling portions of the contact members, disposed opposite the contacting portions, protrude from the body sufficiently spaced apart for convenient probing and/or so that wire wrap connections, another connector and the like may be attached to couple the LCC electrically to an external device, e.g., for signal monitoring, injecting and other purposes.

According to one aspect of the invention, the contacting portions of the contacts are elongate, are parallel and are at least partly contained in enclosed column spaces in the electrically non-conducting body. The remote ends of the contacting portions are exposed beyond the ends of the column spaces to engage the leads of an LCC. Such remote ends may be pressed against such leads with a force that assures good electrical connection, on the one hand, and causes a reaction force in the contacting portions, on the other hand. The reaction force is generally an axial one, i.e. along the axis of the contacting portion, and ordinarily is adequate to cause buckling of the contacting portion. Such buckling is controlled or limited as a function of the space available in the column to be within the elastic limit of the contacting portion and, accordingly, can be predetermined thereby to determine the force with which the remote ends can press against the LCC leads.

Another aspect of the invention relates to use of a support or mounting fixture that provides support for the LCC leads intended to be contacted by the connector, provides a separation between adjacent leads, and helps to locate the connector relative to the leads. The fixture also has use as a carrier for the LCC which, for example, may be a quad pack having fragile gull-wing leads. The fixture is provided with registration pins for engaging in registration holes in a circuit board for properly locating the quad pack on the circuit board.

Preferably, the connector includes a second non-conducting body having a common central axis with and slidably engaging the first body. The second body includes at least two registration pins for engaging a registration index in the support fixture associated with the LCC. The index provides a means of precisely registering the contacting portions of the contact members with the LCC leads. The registration pins preferably protrude from a lower part of the second body that has a shape similar to that of the LCC body. Preferably the two bodies are urged apart along their coincident central axis, for example, by a spring disposed between the bodies.

Since the novel connector applies force only perpendicular to the printed circuit board at locations on the LCC leads where they are supported by a mounting fixture, the integrity of the surface mounting is not threatened by the connector. Because of the direction of the applied force, connector embodiments according to the invention need not occupy any larger area than the surface mounted LCC. As a result, the novel connector can easily be used with a printed circuit board containing a high density of LCC's.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

BRIEF DESCRIPTION OF THE DRAWINGS

In the annexed drawings:

FIG. 1 is a perspective view of a conventional leaded chip carrier;

FIG. 2 is a perspective view of a circumferential mounting fixture according to the invention;

FIG. 4 is a top plan view of the electrical connector shown in FIG. 3;

DETAILED DESCRIPTION

Figure 3:
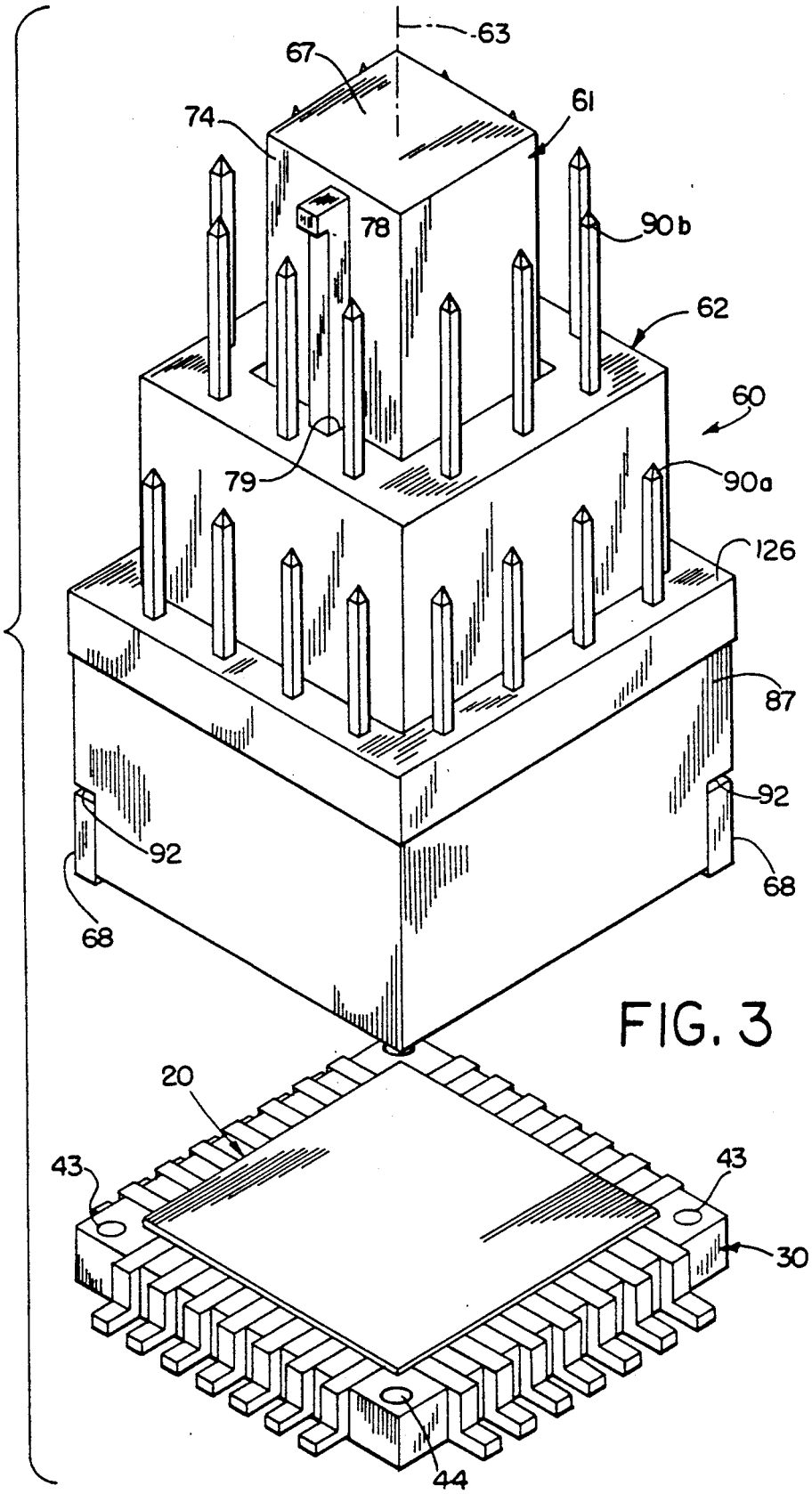
FIG. 3 is a perspective view of an electrical connector according to the invention shown together with the leaded chip carrier of FIG. 1 mounted in the mounting fixture of FIG. 2.

Referring now in detail to the drawings and initially to FIG. 1, a conventional leaded chip carrier (LCC) is designated generally by reference numeral 20. The LCC 20 has a body 21 that is generally rectangular and more particularly square in shape. The body 21 may house one or more integrated circuit chips (not shown) which are interconnected with other circuitry via lead elements 22. The leads have a gull-wing shape and extend from all four sides of the body or more particularly from all four laterally facing side surfaces 23 of the body. The gull-wing shape of each lead arises from two substantially right angle bends that define an outwardly extending inner portion 24, a downwardly extending intermediate portion 25 and an outwardly extending outer termination portion 26. The intermediate portions 25 of the leads extend generally parallel to respective laterally facing side surfaces 23 of the body 21 and the inner and outer portions 24 and 26 extend generally perpendicularly to the laterally facing side surfaces 23. The bent leads are thusly formed for surface mounting the LCC to a printed circuit board. The body 21 may be placed on a printed circuit board with the termination portions 26 of the leads 22 in contact with solder lands. When the printed circuit board is subjected to sufficient heat solder on the solder lands melts. When heating of the printed circuit board is discontinued, the solder solidifies to mechanically and electrically join the leads to the printed circuit board.

The LCC 20 shown in FIG. 1 is of a type referred to as a quad flat pack carrier or more simply a quad pack, to which reference hereinafter will be made. The quad pack 20 shown in FIG. 1 has seven leads extending from each side of the body 21, although the number of leads extending from the sides may vary. Quad packs with 33 leads per side for a total of 132 leads are known. The leads are very delicate and are easily damaged or displaced when unsupported.

In FIG. 2 a circumferential support or mounting fixture according to the invention is designated generally by reference numeral 30. As will be appreciated, the fixture 30 functions to support and protect the fragile leads of the quad pack 20 (FIG. 1). The fixture 30 also has a registration or alignment function which is discussed hereinafter in detail.

As shown in FIG. 2, the fixture 30, made of electrically non-conductive material, includes a rectangular frame 31 having four straight side walls 32 connected to each other and disposed at right angles to each other. The side walls 32 circumscribe a central recess or opening 33 which is sized to receive the body 21 of the quad pack 20 within the side walls 32 preferably with a close fit, as is shown at the bottom of FIG. 3. In the illustrated embodiment the side walls 32 are of equal length and define a square opening for receiving the square body of the quad pack illustrated in FIG. 1.

The walls 32 have planar top surfaces 36 which surround the central opening 33. The planar surfaces 36 each have a plurality of spaced apart grooves 37 extending from the central opening 33 to the outer laterally facing side wall surfaces 38 of the side walls. The grooves 37 are spaced apart and sized to closely receive therein the inner portions 24 of respective leads 22 of the quad pack 20. The grooves have bottom surfaces 39 for supporting the leads, and the leads are supported at their side edges and are electrically isolated from one another by spacer portions 40 defined between relatively adjacent grooves.

As further shown in FIG. 2, two opposite corners of the fixture 30 are provided with openings 43 which function as registration indices whereas the other two opposite corners are provided with latch openings 44. The latch openings are discussed below while here it is noted that the registration openings 43 may be through holes whereby an installation tool may be equipped with locating pins that can pass through and protrude below the fixture for registry in holes provided in the printed circuit board to which the fixture and quad pack are to be mounted. However, in the illustrated embodiment, the openings or holes 43 extend only part way through the fixture while registration with the printed circuit board is obtained by registration pins or pegs protruding beneath the plane of the bottom surfaces of the fixture walls 32.

Figure 6:
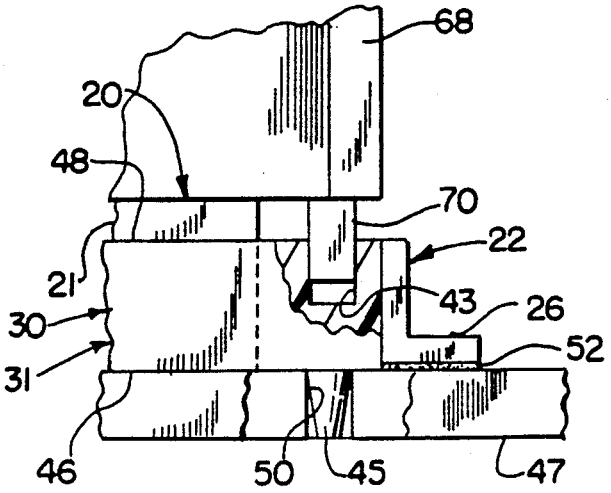
FIG. 6 is a partial elevational view of the FIG. 5 assemblage, taken from line 6—6 of FIG. 4, and being partly broken away in section for illustrating registration between the electrical connector, mounting fixture and printed circuit board.

In FIG. 6 a representative one of the registration pins 45 can be seen to protrude below the plane of the bottom surface 46 of the rectangular frame 31. Although the number of registration pins 45 may vary for different applications, ordinarily two registration pins will be sufficient to effect proper alignment of the fixture on the printed circuit board 47. In the illustrated embodiment the two registration pins are located in axial alignment with respective ones of the registration holes 43 which can be seen in FIG. 6 to extend downwardly from the top surface plane 48 of the rectangular frame about half way the height of the frame 31. Preferably the registration pin 45 is tapered as shown to facilitate insertion of the pin into a corresponding registration hole 50 provided in the circuit board 47, which hole 50 may be straight-sided as shown or correspondingly tapered.

The engagement of the registration pins 45 in the registration holes 50 in the circuit board 47 ensures proper placement of the fixture 30 on the circuit board and more particularly in relation to solder lands on the circuit board which lands are to be contacted by the lead terminations 26 of the quad pack 20. In FIG. 6, a representative one of the lands is shown at 52. After the fixture has been set in place with the registration pins 45 engaged in the registration openings 50, the quad pack 20 may be placed in the fixture with the leads in registration with and set in the grooves 39 (FIG. 2). The grooves will then serve to precisely locate the leads in relation to respective solder lands on the circuit board. Heat may then be applied to effect soldering of the leads to the solder lands. After soldering, the leads will be mechanically and electrically joined to the solder lands whereby the quad pack 20 will be secured to the circuit board with the fixture captured between the quad pack and the circuit board.

As will be appreciated, the fixture 30 need not be first assembled to the circuit board 47 before assembly of the flat pack 20 in relation to the fixture. Rather, the flat pack may be initially placed in the fixture which may then serve as a carrier or sub-carrier to facilitate handling and storage of the quad pack, to protect the leads of the quad pack during handling and storage, and to provide for proper alignment of the leads with the solder lands on the circuit board during assembly. The fixture also enables the use of a robot for assembly of the quad pack to a circuit board. The fixture provides structure more suitable for gripping by a robot. For example, a robot may be provided with pin-like jaws which may be inserted into the registration holes 43 (and also latch holes 44 if desired) and then either moved towards or away from one another to grip the fixture so that the fixture may be transported from a pick-up station to an assembly station for placement of the quad pack-fixture subassembly on a circuit board.

When the quad pack 20 and fixture 30 are mounted to the circuit board 47 as above described, the bottom surfaces 39 of the grooves 37 will support the inner portions 24 of the gull-wing leads 22 to resist forces applied to the leads when an electrical connector according to the invention is used to make electrical connections with the leads of the quad pack. In FIG. 3 an electrical connector according to the invention is generally indicated by reference numeral 60. The connector 60 may be used as a test probe for testing the integrated circuit or circuits of the quad pack 20 when the quad pack is mounted to the printed circuit board. More particularly, the connector 60 provides electrical circuit connection points that are more accessible and suitable for connecting and testing than the relatively fragile and closely packed leads of the quad pack on the circuit board.

Figure 5:
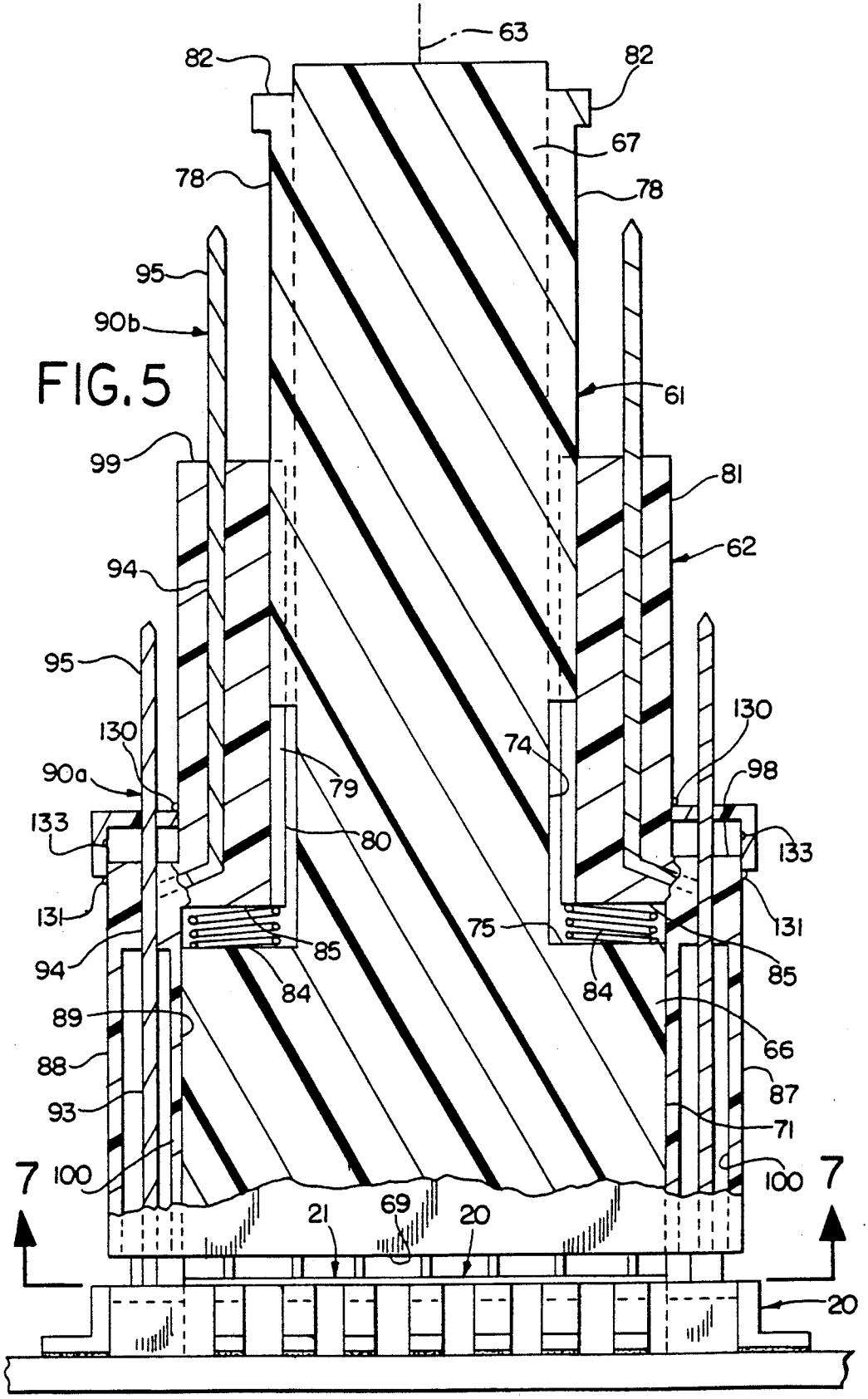
FIG. 5 is a sectional view, taken along the line 5—5 of FIG. 4, of the electrical connector which is shown positioned atop the leaded chip carrier and mounting fixture installed on a printed circuit board.

In FIGS. 3–7, the electrical connector 60 can be seen to generally comprise two associated electrically non-conducting bodies 61 and 62. The body 61 is herein more descriptively referred to as an inner support or core member whereas the outer body 62 is herein more descriptively referred to as an outer housing member. The inner support member 61 and outer housing member 62 have central axes that are substantially coincident along the central axis 63 of the connector. As shown in FIG. 5, the axis 63 of the electrical connector normally will be oriented perpendicularly to the planar extent of the body 21 of the quad pack 20.

The inner support member 61 has a lower base portion 66 and an upper column portion 67. The base portion 66 has a transverse cross-sectional shape similar to that of the body 21 of the quad pack 20. Accordingly, the base portion 67 is generally square in transverse cross-sectional shape.

Figure 7:
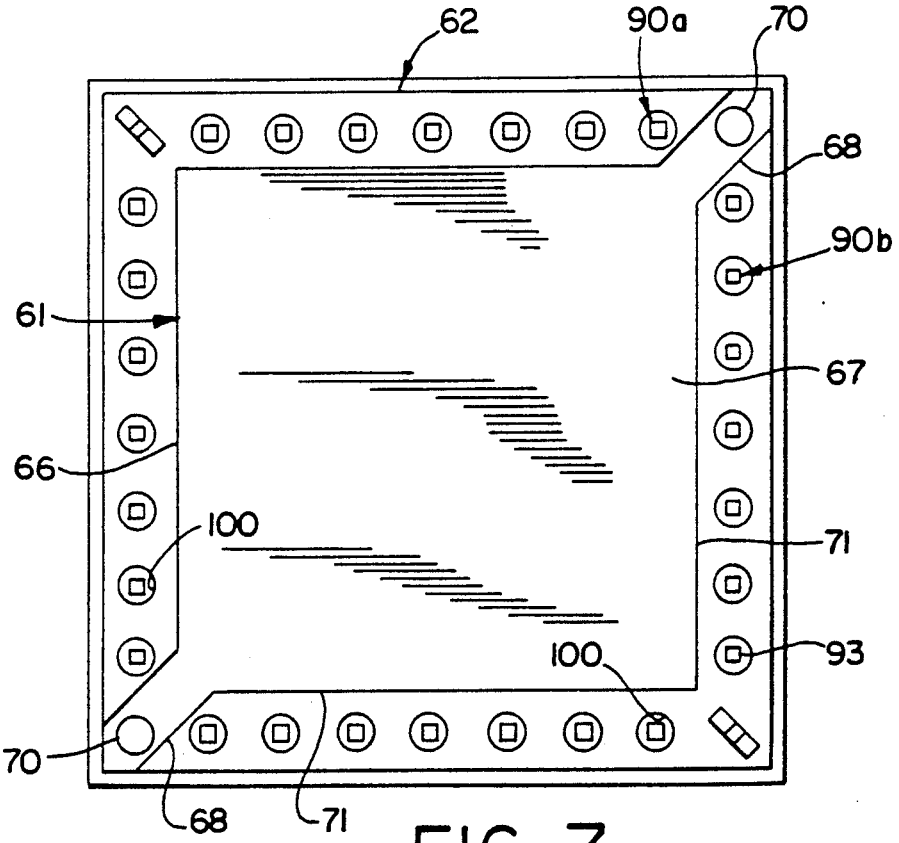
FIG. 7 is a bottom plan view of the electrical connector taken from line 7—7 of FIG. 5.

At the lower end of the base portion 66 of the inner support member 61 there are provided a pair of diagonally opposed projections or ears 68 which are best shown in FIGS. 3 and 7. The ears 68 project diagonally outwardly from opposite corners of the base portion 67 with the bottom surface of the ears 68 flush with the bottom surface 69 of the base portion 67. Each ear is provided with a depending locating or registration pin 70 which is diagonally outwardly offset from relatively adjacent side surfaces 71 of the base portion 67 as best seen in FIG. 7. The registration pins 70 are dimensioned to closely fit in respective registration openings 43 in the fixture 30 when the connector 60 is placed atop the quad chip 20 to which electrical connection is to be made. In FIG. 6 one of the registration pins 70 is shown inserted into the corresponding registration opening 43 in the fixture 30, this properly positioning the inner support member 61 in proper registry with the fixture 30 and consequently the quad pack 20.

As shown in FIGS. 3 and 5 the upper column portion 67 of the inner support member 61 has side surfaces 74 parallel to and laterally inwardly offset from corresponding side surfaces 71 of the base portion 66. Consequently, the base portion 66 has a top surface 75 which surrounds the column portion 67 at its point of joinder with the base portion.

The outer housing member 62, which has a stepped configuration roughly corresponding to that of the inner support member 61, is supported on the inner support member 61 for relative sliding movement along the longitudinal axis 63 of the connector. A guide means is provided to maintain alignment of the relatively sliding members 61 and 62 which, in the illustrated embodiment, is in the form of mating tongues and grooves. The tongues are formed by longitudinally extending ribs 78 which are centered on and protrude outwardly from respective opposite side surfaces 74 of the upper column portion 67. The ribs are engaged in complementary grooves 79 formed in respective inside surfaces 80 of an upper portion 81 of the outer housing member 62.

At the top of the ribs there are provided laterally outwardly projecting retention ears 82 which prevent the outer housing member from being separated from the inner support member. If desired, the retention ears 82 may be located lower on the upper column portion of the inner support member to decrease the range of relative movement of the outer housing member which has the upper portion 81 thereof trapped between the ears 82 and the top surface 75 of the lower base portion 67 of the inner support member. For a reason that will become more apparent from the following discussion, the outer housing portion 62 is normally supported atop the lower base portion 67 of the inner housing member 61 by one or more springs 84. The springs 84 are interposed between the top surface 75 and an inner shoulder surface 85 of the outer housing member 62.

The outer housing member 62 also has a lower portion 87 consisting of four side walls 88 that are connected to each other and disposed at right angles to each other. The side walls 88 forming the lower portion of the outer housing member 62 have respective inner surfaces 89 which slide on respective outer surfaces 71 of the lower base portion 66 of the inner support 61 further to maintain alignment of the relatively movable members 61 and 62. The lower portion 87 has slots 92 at diagonally opposite corners in which the ears 68 are free to move axially.

As best seen in FIG. 5, the outer housing member 62 houses a plurality of contact members **90*a* and 90*b*. The contact members 90*a* and 90*b* generally have a lower contacting portion 93, an intermediate mounting portion 94 and an upper coupling portion 95. In the illustrated embodiment the connecting, mounting and coupling portions of each contact member are unitary, the same being formed by a wire of square cross-section. However, it will be appreciated that the contact members may each be formed of discrete sections electrically interconnected and suitably supported and housed in the outer housing member 62**.

The contacting portions 93 of the contact members **90*a* and 90 *b* are arranged in four rows at respective sides of the electrical connector 60 at a spacing corresponding to the spacing between the leads 22 of the quad pack 20 to which the electrical connector is to be connected. To provide for a desired physical spreading apart of the coupling portions 95 of the contact members at each side of the outer housing member 62 the coupling portions of alternate contact members 90*a* and 90*b* respectively project from lower and upper tiers or tiered surfaces 98 and 99 of the outer housing member 62. Consequently, the lateral spacing between the coupling portions at each tier will be twice that of the spacing between leads of the quad pack. Also, the coupling portions at each side of the electrical connector will be disposed in two rows which are spaced apart along the axis 63**.

As best seen in FIG. 5, the coupling portion 95 of each contact member **90*a*, 90*b* is joined to the contacting portion 93 by the intermediate mounting portion 94. The mounting portion is supported in the outer housing member 62. Preferably the outer housing member 62 is molded around the mounting portions of the unitary contact members using conventional molding techniques. The contact members 90*a* are substantially straight wire elements whereas the contact members 90*b*, which alternate with contact members 90*a*, have the mounting portions thereof bent to inwardly offset the coupling portions thereof from the coupling portions of the contact members 90*a*. Also, the mounting portions for the contact members 90*b* are of substantially greater length than the mounting portions of contact members 90*a*, as shown in FIG. 5**.

The contacting portions 93 of the contact members **90*a* and 90*b* extend parallel to the connector axis 63 and downwardly through the lower side walls 88 of outer housing member 62. The side walls 88 have interior wall surfaces 100 which encircle the contacting portions of respective contact members as best seen in FIGS. 5 and 7**, and thereby form what may be termed column spaces in the outer housing member. The interior wall surfaces, which may be cylindrical as shown, are spaced from the contacting portions to permit buckling of each contacting portion when an axial force is applied to the lower end of the contacting portion. In addition to permitting buckling of the contacting portion over substantially the entire length of the region thereof encircled by the corresponding interior wall surface, relatively adjacent interior wall surfaces define therebetween spacer portions of the outer housing side walls which serve to electrically isolate the flexible contacting portions.

Figure 9:
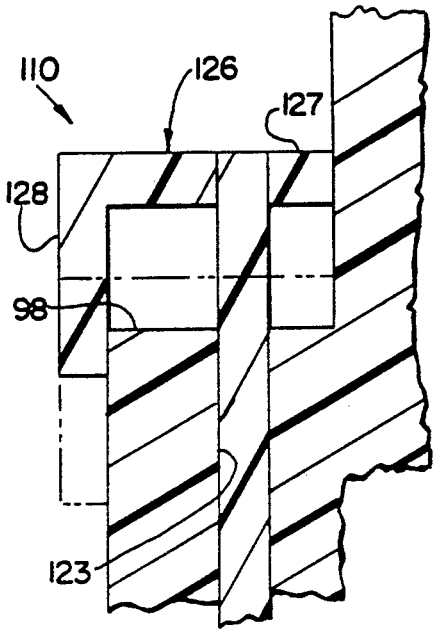
FIG. 9 is a partial sectional view of the electrical connector showing a contact of the electrical connector prior to the electrical connector being actuated to engage the contacts thereof with respective leads of the leaded chip carrier.
Figure 9:
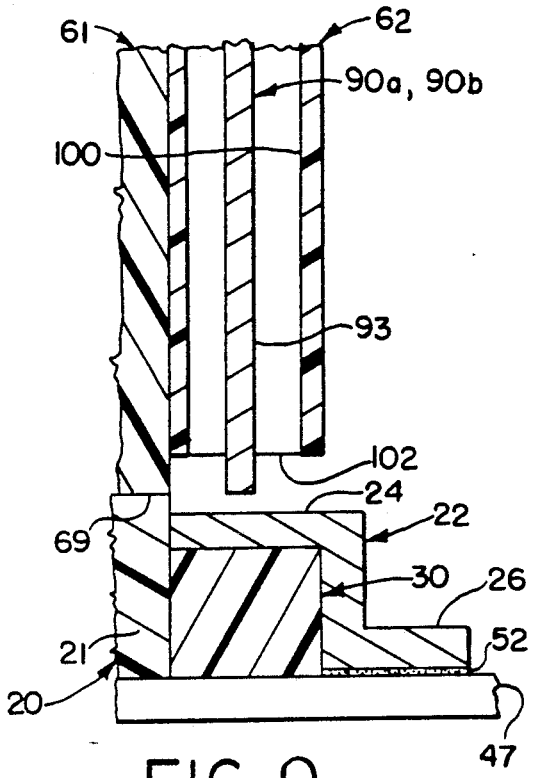

The connecting portions 93 of the contact members **90*a* and 90*b* project beyond a bottom surface 102 of the outer housing member 62 as best seen in FIG. 9. Normally the outer housing member is urged upwardly by the springs 84 (FIG. 5) to position the lower ends of the contacting portions at or above the plane of the bottom surface 69 of the inner support member 61. Hence, when the electrical connector 60 is placed atop the quad pack 20 for effecting electrical connection between the contact members thereof with respective leads 22 of the quad pack, the lower ends of the contacting members will be disposed at or above the top surface of the quad pack against which the bottom surface of the inner support member rests. When the inner support member is set atop the quad pack body the registration pins 70 (FIG. 6) will be engaged in the registration openings in the fixture to properly register the contacting portions of the contact members with respective leads 22 of the quad pack. More particularly, the contacting portions will be registered with the inner outwardly extending portions 24 of the leads 22 which, as shown in FIG. 9, are supported by the fixture 30**.

Figure 10:
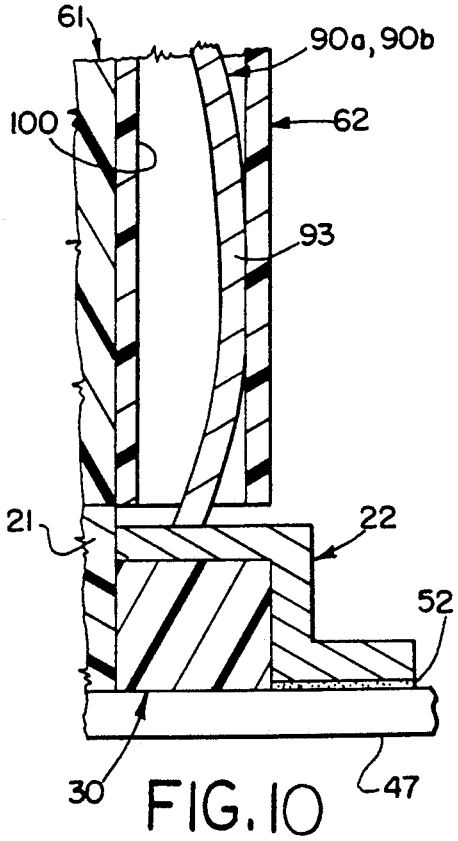
FIG. 10 is a partial sectional view similar to FIG. 7 but showing buckling of the contact after the electrical connector has been actuated to engage the contacts with the leads of the leaded chip carrier.

After the electrical connector 60 has been placed atop the quad pack 20 on the printed circuit board 47, the electrical connector may be actuated by urging the outer housing member 62 downwardly along the inner support member 61 against the biasing force of the springs 84. This may be accomplished by manually gripping the outer housing member and pushing it downwardly. As the outer housing member is slid downwardly along the inner support member the contacting portions 93 of the contact members 90*a* and 90*b* will engage respective leads 21 of the quad pack 20 and then eventually buckle as shown in FIG. 10. This buckling is known as Euler column buckling which provides for generally uniform application of force by the contact member to the lead. The buckling compensates for any variations in length of the contacting portions or in the thicknesses of the leads. Although the leads are very delicate, the support they receive from the fixture is sufficient to enable them to withstand the pressure applied by the contacting portions.

As above noted, the contacting portions 93 of the contact members 90*a* and 90*b* protrude slightly from the bottom surface 102 of the outer housing member 62. The length of this projection should be sufficient to permit buckling of the contacting portions generally as shown. If a contacting portion protrudes too little, then the outer housing member may reach its lowermost engaged position before buckling occurs or before sufficient pressure is applied to obtain a desirable electrical connection. If a contacting portion protrudes too far then overstressing of the contacting portion or quad pack lead may occur.

Although the outer housing member 62 may be held depressed during use of the electrical connector 60, it would be more desireable to have means which functions to hold the electrical connector to the quad pack in its actuated or engaged condition. To this end the electrical connector is provided with latch and retainer mechanisms located at diagonally opposed corners of the electrical connector. The latch and retainer mechanisms are arranged to engage in respective ones of the diagonally opposed latch openings 44 in the fixture 30 when the outer housing member is actuated to engage the contact members 90*a* and 90*b* with the leads 22 of the quad pack 20.

Figure 8:
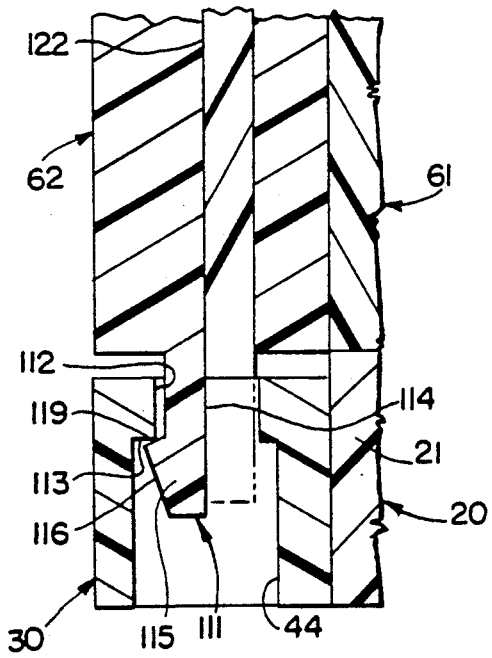
FIG. 8 is a partial diagonal sectional view of the electrical connector taken along line 8—8 of FIG. 4.

A representative one of the two latch and retainer mechanisms is indicated at 110 in FIG. 8. As shown, the latch and retainer mechanism includes a latch 111 which depends from the outer housing member 62. The latch is positioned at the corner of the outer housing member for insertion into the corresponding latch opening 44. The latch opening has a reduced diameter neck 112 forming an impediment or catch 113 for the latch.

The latch 111 has a flexible stem 114 and a hook 115. The hook 115 has a ramp surface 116 for inwardly deflecting the hook 115 during insertion of the lach through the reduced diameter neck 112 as the outer housing member 62 is urged downwardly relative to the fixture 30. When the hook 115 passes over the catch 113 the resilience of the stem 114 of the latch will cause the hook to snap back to its original unstressed condition with the top surface 119 of the hook caught underneath the catch. Preferably the top surface of the hook is sloped slightly to facilitate disengagement of the hook when the outer housing member is pulled away from the fixture during disengagement of the electrical connector in relation to the fixture and quad pack.

Unintentional disengagement of the latch 111 is prevented by a retainer in the form of a locking pin 122. The locking pin extends through a longitudinally extending hole 123 in the outer housing member 62 which hole guides the locking pin for relative sliding movement in a direction parallel to the axis 63 of the electrical connector. The upper end of the locking pin is attached to a control slide 126 supported on the outer housing member for relative axial movement. The control slide can be seen in FIG. 3 to be in the form of a shoulder cap structure which encircles the outer housing member in the region of the lower step thereof forming the lower tier 98. The control slide has an upper ring portion 127 and a skirt portion 128 depending from the outer perimeter of the upper ring portion. As seen in FIGS. 3 and 5 the upper ring portion includes apertures for passage therethrough of the coupling portions 95 of contact members 90*a*. The control slide 126 is movable between an upper latch release position and a lower locking position respectively shown in solid and phantom lines in FIG. 8.

As seen in FIG. 5, the control slide is releasably retained in its upper position between upper and lower beads 130 and 131 on the outer housing member 62. As shown, the beads may be provided on one or more sides of the outer housing member with the upper beads 130 at one elevation and the lower beads 131 at a lower elevation. The skirt portion 128 of the control slide 126 has sufficient resilience to be deflected outwardly for passage over the lowermost beads 130 when the control slide is pushed downwardly relative to the outer housing member 62 to its locking position. When in its locking position the lower beads engage in respective detents 133 provided in the inner wall surface of the skirt portion to releasably hold the control slide in its locked position.

When the control slide 126 is moved between its latch release and locking positions, the locking pin 122 moves between its solid line and phantom line positions shown in FIG. 8. The movement path of the lower end portion of the locking pin is inwardly adjacent the latch at the side thereof opposite the hook surface 119 and the ramp surface 116. When the locking pin is in its uppermost or latch release position the latch is free to deflect into the path of the locking pin whereby the latch may be inserted through the narrow neck 112 of the latch opening 44 in the fixture 30 to its latched position seen in FIG. 8. When thusly inserted upon lowering of the outer housing member 62 relative to the inner housing member 61 and fixture 30 as shown, the control slide 126 may be slid downwardly to its locking position. This shifts the locking pin downwardly so that the lower end portion thereof is adjacent and coextensive with the latch over substantially the entire length thereof. This precludes inward deflection of the latch thereby to hold the latch engaged in the latch opening whereby the outer housing member will be securely latched to the mounting fixture. To release the outer housing member from this latched condition, the control slide is pulled upwardly relative to the outer housing member so that the latch can once again deflect away from the catch 113. When thusly released the outer housing member can be lifted away from the fixture. As above noted the top surface 119 of the latch hook 115 is sloped slightly to provide a slight camming action on the hook to facilitate separation of the hook from the fixture.

Figure 11:
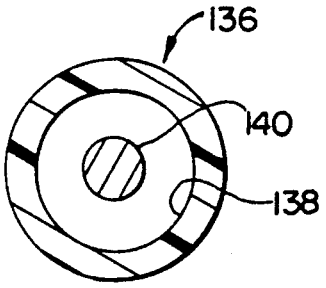
FIGS. 11 and 12 are cross-sectional views showing alternative housing structures for the portions of the contacts which buckle upon actuation of the electrical connector.
Figure 12:
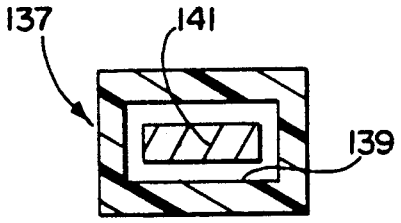

Referring now to FIGS. 11 and 12, modified forms of enclosures for the contacting portions of the contacts are shown at 136 and 137, respectively. The side walls at the lower end of the outer housing member may be replaced by four rows of plural discrete tube-like enclosures like those shown, such enclosures 136 and 137 depending in parallel relationship from the upper portion of the outer housing member in which the mounting portions of the contact members are mounted. As seen in FIG. 11, each enclosure 136 may be circular in cross-section or, as seen in FIG. 12, each enclosure 137 may be of rectangular cross-section. In each case, the interior wall surface 138, 139 of the enclosure 136, 137 is spaced from the corresponding contacting portion 140, 141 to permit buckling of the contacting portion as above described. As is further illustrated in FIGS. 11 and 12, the contacting portion may have a circular cross-section (140, FIG. 11) or a rectangular cross-section (141, FIG. 12).

As best seen in FIGS. 4 and 5, the connector 60 may occupy an area on a printed circuit board no larger than that occupied by the quad pack 20 with which the connector is used. Therefore, the connector can be use with a printed circuit board containing a high density of integrated circuit packages since the connector requires no clearance beyond the area occupied by the surface mounted integrated circuit package. The electrical connector is especially useful for making temporary connections for test purposes.

The invention has been described with respect to a preferred embodiment. Other embodiments within the spirit of the invention will occur to those of skill in the art.

I claim:

1. A connector for making electrical connections to a leaded chip carrier comprising:

a generally peripheral arrangement of electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions along the regions of said contacting portions that become buckled by stress applied generally along said axis, for mutually electrically insulating said contacting portions when said contacting portions are thusly buckled, said insulating means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis; and wherein said body means includes an upper body portion in which said mounting portions of said contact members are secured, and said insulation means comprises a plurality of tubes each open at one end and depending from said upper body portion, one of said tubes surrounding each of said contacting portions.

2. A connector for making electrical connections to a leaded chip carrier, in combination with a circumferential mounting fixture means for mounting said chip carrier, said connector comprising:

a generally peripheral arrangement of electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions along the regions of said contacting portions that become buckled by stress applied generally along said axis, for mutually electrically insulating said contacting portions when said contacting portions are thusly buckled, said insulation means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis, and said fixture means including a plurality of groove means, each of said groove means for receiving and supporting one of said lead elements in response to pressure applied by one of said contacting portions.

3. The connector of claim 2, wherein said body means and said fixture means include indexing means for registration of said contacting portions with said lead elements.

4. A connector for making electrical connections to a leaded chip carrier comprising:

a generally peripheral arrangement of electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions along the regions of said contacting portions that become buckled by stress applied generally along said axis, for mutually electrically insulating said contacting portions when said contacting portions are thusly buckled, said insulation means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis, and wherein said body means includes an outer body member and an inner body member, said mounting portions of said contact members being secured to said outer body member, said outer body member including said insulation means, and said inner body member slidably supporting said outer body member for relative movement along said axis.

5. The connector of claim 4, wherein said outer body member has a generally rectangular cross-section transverse to said axis and said coupling portions protrude from said outer body member generally parallel to said axis at each side of said outer body member.

6. A connector for making electrical connections to a leaded chip carrier comprising:

a generally peripheral arrangement of electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions along the regions of said contacting portions that become buckled by stress applied generally along said axis, for mutually electrically insulating said contacting portions when said contacting portions are thusly buckled, said insulation means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis; and wherein said body means includes an outer body member and an inner body member, said mounting portions of said contact members are secured to said outer body member, said outer body member includes said insulation means, said inner body member slidably supports said outer body member for relative movement along said axis, and said inner body member includes registration means for engaging a registration index associated with said carrier body to register said contacting portions with said lead elements.

7. The connector of claim 6, in combination with a circumferential mounting fixture means for mounting said chip carrier, said fixture means including a plurality of groove means, each of said groove means for receiving and supporting one of said lead elements in response to pressure applied by one of said contacting portions, said registration means comprising at least two complementary protrusions and receptacles, said protrusions and receptacles being disposed on said fixture means and said inner body member for engagement when said contacting portions are in registration with said lead elements.

8. The connector of claim 7, including resilient biasing means disposed between said inner and outer body members for urging said inner and outer body members apart in a direction along said axis.

9. A connector for making electrical connections to a leaded chip carrier comprising:

a generally peripheral arrangement of electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions along the regions of said contacting portions that become buckled by stress applied generally along said axis, for mutually electrically insulating said contacting portions when said contacting portions are thusly buckled, said insulation means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis; and wherein said body means includes an outer body member and an inner body member, said mounting portions of said contact members are secured to said outer body member, said outer body member includes said insulation means, said inner body member slidably supports said outer body member for relative movement along said axis, said outer body member includes an upper body portion in which said mounting portions of said contact members are secured, and said insulation means comprises a plurality of tubes each open on one end and depending from said upper body portion, one of said tubes surrounding each of said contacting portions.

10. A connector for making electrical connections to a leaded chip carrier comprising:

a plurality of electrical contact members, each member including a contacting portion for mechanically and electrically contacting a conductive lead element of a chip carrier having a plurality of conductive lead elements extending outwardly from its perimeter, said members being arranged so that each of said lead elements may be simultaneously contacted by one of said contacting portions; and electrically non-conductive body means, having a central axis, for supporting said contact members, each of said contact members including a mounting portion secured to said body means, a coupling portion for electrically connecting said member to other apparatus and said contacting portion, said contacting portion being flexible and protruding from said body means generally parallel to said axis, said body means including insulation means spacedly surrounding each of said contacting portions along the regions of said contacting portions that become buckled by stress applied generally along said axis, for mutually electrically insulating said contacting portions when said contacting portions are thusly buckled, said insulation means having inner wall surfaces, and said regions of said contacting portions being encircled by said inner wall surfaces over substantially the entire length of said regions and being spaced from said inner wall surfaces for buckling relative to said inner wall surfaces upon application of stress generally along said axis; and wherein said body means includes a first electrically non-conductive body for supporting said contact members and a second electrically non-conductive body, said mounting portions of said contact members being secured to said first body, said first body including said insulation means, and said second body slidably engaging said first body for relative movement along said axis for contacting said carrier body to register said contacting portions with said conductive lead elements.

11. The connector of claim 10, wherein said second body includes registration means for engaging a registration index associated with said carrier body to register said contacting portions with said lead elements.

12. The connector of claim 11, in combination with a circumferential mounting fixture means for mounting said chip carrier, said fixture means including a plurality of groove means, each of said groove means for receiving and supporting one of said lead elements in response to pressure applied by one of said contacting portions, said registration means comprising at least two complementary protrusions and receptacles, said protrusions and receptacles being disposed on said fixture means and said second body for engagement when said contacting portions are in registration with said lead elements.

13. The connector of claim 10, including resilient biasing means disposed between said first and second body means for urging said first and second body means apart in a direction along said axis.

14. The connector of claim 10, wherein said first body means includes an upper body portion in which said mounting portions of said contact members are secured, and said insulation means comprises a plurality of tubes each open at one end and depending from said upper body portion, one of said tubes surrounding each of said contacting portions.

15. A mounting system comprising a circuit board, a mounting fixture and a leaded chip carrier, said leaded chip carrier including a carrier body and a plurality of conductive lead elements extending outwardly from four sides of said carrier body, said mounting fixture including a circumferential, electrically non-conducting support base supported atop the circuit board and including a plurality of grooves, each of said grooves receiving and supporting a lead element extending from said leaded chip carrier, which lead element is soldered to a conductive member on said circuit board, and said circumferential base including a central opening for receiving the body of said leaded chip carrier, and wherein each lead has a first outward extending portion, a downward extending portion and a second outward extending portion, said grooves have bottom surfaces for supporting the first outward extending portions, and said lead elements are soldered to said conductive members on said circuit board at the second outward extending portions which extend outwardly from said support base.

16. The system of claim 15, including registration means for registering said fixture to said circuit board.

17. A carrier for supporting a leaded integrated circuit quad pack device and for protecting the leads for, during and after mounting the same to a circuit board, said leaded integrated circuit device having a body and gull-wing leads extending from four sides of said body, with each lead having an outward extending portion, a downward extending portion, and a second outward extending termination, said carrier comprising:

a rectangular frame having four straight side walls connected to each other and disposed at right angles to each other, recess means for receiving the body of a said leaded integrated circuit device within said side walls, said recess being spaced from laterally outwardly facing surfaces of said side walls by planar surfaces surrounding said recess, and said planar surfaces having a plurality of spaced grooves communicating between said recess and said outwardly facing surfaces of said straight walls, said grooves having bottom surfaces for supporting the leads from a said leaded integrated circuit device, and said side walls affording the second outward extending termination of each lead to be disposed outward of said side walls and on a printed circuit board so that said carrier stays in a supporting position for the body with the leads of an integrated circuit device on the printed circuit board.

18. A carrier according to claim 17, wherein said recess is an opening through the central portion of said frame.

19. A carrier according to claim 17, wherein said frame has registration means associated with the connection between said four straight walls for registration of said frame with a printed circuit board.

20. A carrier according to claim 19, wherein said registration means further provides registration for a connector to be removably connected to said leads and fitting over said carrier and a said integrated circuit device.

21. A carrier according to claim 20, wherein said connector comprises a generally peripheral arrangement of plural electrical contact members for making electrical connections between (i) the leads of a said integrated circuit device and (ii) other apparatus, and electrically non-conductive body means, having a central axis, for supporting said contact members including a mounting portion secured to said body means, a coupling portion for electrically connecting said member to other apparatus and a flexible contacting portion protruding from said body means generally parallel to said axis, for electrically and mechanically contacting one of the leads of a said integrated circuit device, said body means including insulation means spacedly surrounding each of said contacting portions for mutually electrically insulating said contacting portions when said contacting portions are buckled by stress applied generally along said axis, and said body means including registration means cooperating with said registration means of said carrier.

22. A connector for making electrical connections to a leaded chip carrier and a circumferential mounting fixture for mounting the leaded chip carrier, said connector comprising:

a generally peripheral arrangement of plural electrical contact members for making electrical connections between (i) the conductive lead elements of a chip carrier having a carrier body and a plurality of conductive lead elements extending outwardly from said carrier body and (ii) other apparatus; and electrically non-conductive body means, having a central axis, for supporting said contact members, each of said contact members including a mounting portion secured to said body means, a coupling portion for electrically connecting said member to other apparatus and a flexible contacting portion protruding from said body means generally parallel to said axis, for electrically and mechanically contacting one of the conductive lead elements, said body means including insulation means spacedly surrounding each of said contacting portions for mutually electrically insulating said contacting portions when said contacting portions are buckled by stress applied generally along said axis; and said mounting fixture comprising a plurality of groove means, each of said groove means for receiving and supporting one of the lead elements of the leaded chip carrier in response to pressure applied by one of said contacting portions, and said body means and said fixture including indexing means for registration of said contacting portions with the lead elements, said indexing means including at least two complementary protrusions and receptacles, said protrusions and receptacles being disposed on said fixture and said body means for engagement when said contacting portions are in registration with the lead elements of the leaded chip carrier.

* * * * *